United States Patent [19]

McDonald, Jr.

[11] 4,103,465

[45] Aug. 1, 1978

[54] MODULAR PANEL DISPLAY SYSTEM

[75] Inventor: Leo S. McDonald, Jr., Glenview, Ill.

[73] Assignee: Greyhound Exhibitgroup, Inc., Elk Grove, Ill.

[21] Appl. No.: 827,483

[22] Filed: Aug. 25, 1977

[51] Int. Cl.[2] ..... E04C 2/42; A47G 5/00; E04B 2/74

[52] U.S. Cl. ..... 52/127; 52/238; 52/239; 52/243; 52/475; 52/586

[58] Field of Search ..... 52/127, 239, 475, 238, 52/243, 586, 496, 282; 160/135, 351

[56] References Cited

U.S. PATENT DOCUMENTS

| | | | |
|---|---|---|---|
| 2,790,258 | 4/1957 | Freshour | 160/135 X |
| 3,170,201 | 2/1965 | Nofziger | 52/586 X |
| 3,428,108 | 2/1969 | Singer | 52/239 X |
| 3,485,519 | 12/1969 | Chiu | 52/475 X |
| 3,696,855 | 10/1972 | Kira | 52/586 X |
| 3,841,042 | 10/1974 | Siegal | 52/282 X |
| 3,861,101 | 1/1975 | Whisson | 52/238 |
| 3,861,112 | 1/1975 | Caroselli | 52/127 |
| 3,966,342 | 6/1976 | Moriya | 52/645 |
| 3,971,182 | 7/1976 | Donahue et al. | 52/239 X |
| 4,021,973 | 5/1977 | Hegg et al. | 52/239 X |

FOREIGN PATENT DOCUMENTS

| | | | |
|---|---|---|---|
| 1,313,182 | 11/1962 | France | 160/135 |

*Primary Examiner*—Alfred C. Perham

*Attorney, Agent, or Firm*—Charles E. Cates; Frank T. Barber

[57] ABSTRACT

The disclosure teaches an improvement to a type of novel modular display panel which in the prior art required removal of the frames in rearranging. The improved system can be quickly assembled, disassembled, rearranged and newly assembled in different panel order without the necessity of taking the panels out of their frames. Multiple panels are joined together by means of elongate vertical frames and center posts having reciprocally mating splines and keyways which freely move longitudinally such that the center post can be slipped out, the panels rearranged and the center post put back in to position. The stability of the system is secured by providing a temporary removable insert in the keyways carrying an elastomeric material which is expanded to frictionally engage the side walls of the keyways. The elastomeric material can be reversably contracted to release the sidewalls.

6 Claims, 2 Drawing Figures fig. 1
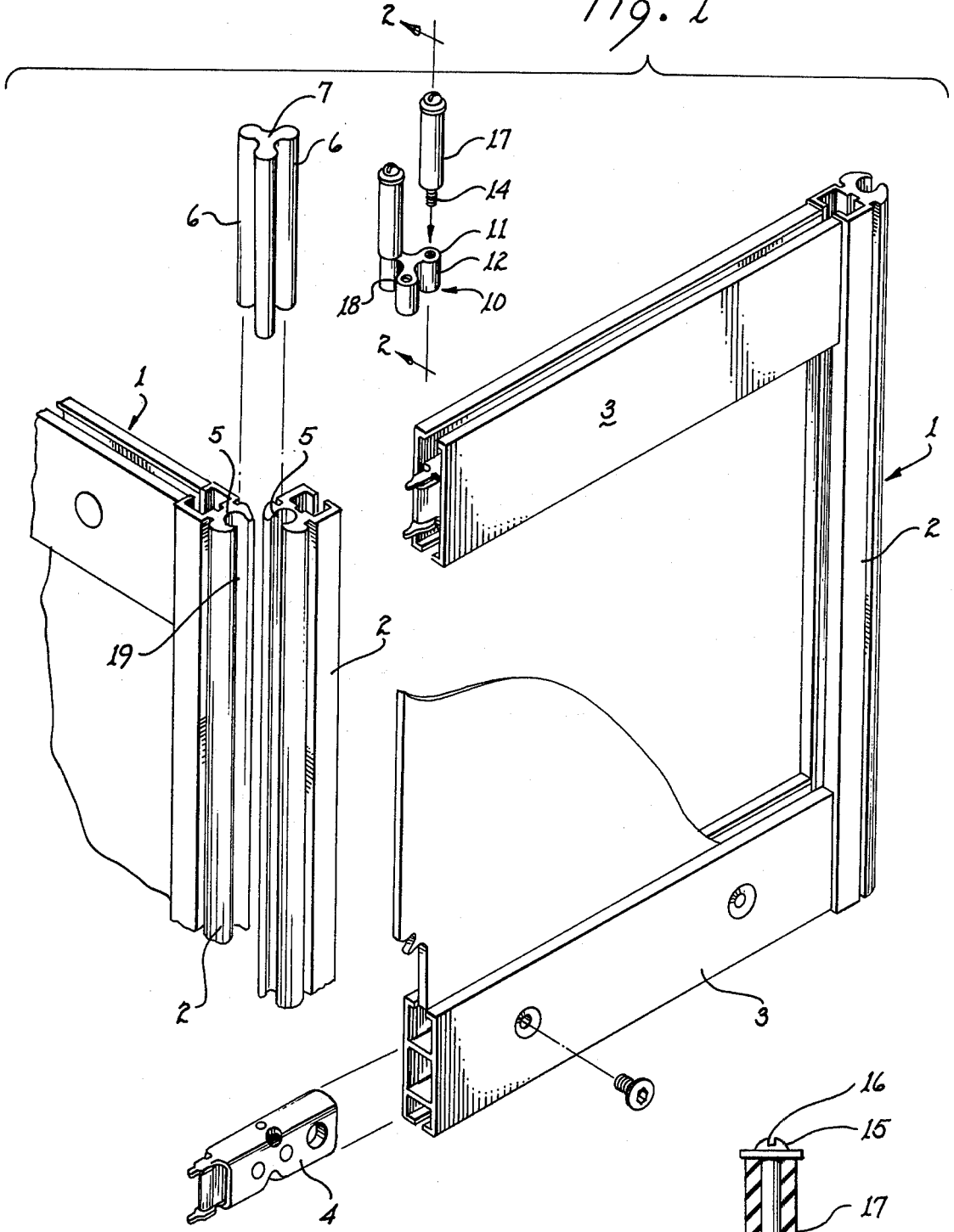
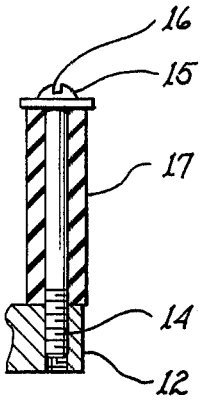
fig. 2

MODULAR PANEL DISPLAY SYSTEM

BACKGROUND OF THE INVENTION

This invention relates to improvements to temporary display panels and to means for facilitating the assembly, disassembly and rearrangement of such panels.

Temporary display panels which are set up for use for only a few days or weeks are commonly used to display advertising or goods at conventions and trade shows. Once set up a display might have to be moved or rearranged for better effect or to meet a change in conditions. At conventions and trade shows time is short and especially in last minute preparations for opening or in moves during the proceedings it is desirable to hold interruptions of displays to an absolute minimum.

In the prior art displays are commonly assembled with profile parts serving as support posts to which panels are secured in a particular system by means of locking devices attached at both ends of horizontal stretchers extending between two support posts. The locking devices have fingers adapted to be inserted into cavities in the profile part to be expanded to grip the walls defining the cavities. The patent to Moriya, U.S. Pat. No. 3,966,342 and to Staeger, German patent application No. G 7421 929.7 illustrate the general type of system this invention improves.

Typically the panels are secured by means of the horizontal stretchers bridging the support posts by suspending from the top stretcher or enclosing between the top and bottom stretchers. In the event, as is often the case, that displays need to be rearranged, the panel assemblies must be taken apart because the stretchers must be removed from the posts in order to rearrange the panels. This is a time consuming operation in an environment where time is at a premium.

BRIEF SUMMARY OF THE INVENTION

The object of this invention is to relieve in substantial measure the problem referred to by providing means to quickly disassemble, rearrange and reassemble display panels. To this end there is provided a modular display panel system which has a plurality of panels, each of which is provided with a vertical frame on at least one side, at least one vertical post, and means defining cosely fitting longitudinal mating splines and keyways in the post and vertical frames, and means for temporarily and releasably preventing longitudinal movement of the frames relative one another, i.e., an insert adapted to fit the keyways, an elastomeric material carried by the insert, and means for expanding and contracting the elastomeric material to frictionally engage the walls of the keyways.

In a particular embodiment the splines are carried by the post and the keyways are carried by the vertical frames, and means for temporarily and releasably preventing longitudinal movement of the fframes relative one another, i.e., an insert adapted to fit the keyways, an elastomeric material carried by the insert, and means for expanding and contracting the elastomeric material to frictionally engage the walls of the keyways.

In a particular embodiment the splines are carried by the post and the keyways are carried by the vertical frames, and conveniently the means for expanding and contracting the elastomeric material is a tapped bore in an end of the insert, a screw disposed in the tapped bore having a threaded shank and a head forming a flange on the shank, an elastomeric sleeve carried by the shank, and means for turning the shank such that the sleeve of elastomeric material shortens and expands radially to frictionally engage the walls of the keyways in response to the turning of the screw one way and lengthens and contracts radially when the screw is turned in the opposite direction.

DETAILED DESCRIPTION OF THE PREFERRED EMBODIMENT

A fuller understanding of the invention may be gathered from consideration of the drawings in which:

FIG. 1 is a perspective view of the system showing the parts thereof and their relationship in exploded perspective;

FIG. 2 is a section of a detail of the insert along the lines 2—2 in FIG. 1. Referring now to FIG. 1, the panel is generally indicated at 1 and in this embodiment comprises a vertical frame 2 on each side, a horizontal frame 3 at top and bottom, and a locking device 4 securing the horizontal frames 3 to the vertical frame 2.

In this preferred embodiment the keyways 5 are carried by the vertical frame 2 and the splines 6 are carried by the post 7. A three-way connector is shown, although it should be understood that four-way connectors and other configurations can be as easily adapted to the invention. The splines 6 slide longitudinally into the keyways 5 to hold the frames, and therefore the panels, in the desired plan position That is, in a plan view the display panels are positioned as desired and the splines of the post engage the keyways to retain that position.

However, the system is not complete at this point because it is necessary to prevent longitudinal movement of one frame relative an adjacent frame in order to stabilize the system vertically. To accomplish this the insert generally indicated by numeral 10 is provided.

In cross section the insert is almost identical to the post 7, the difference being that the insert is preferably short whereas the post may be almost as long as the vertical frames. An end 11 of splines 12 carried by the insert 10 is broached and internally threaded for reception of an externally threaded shank 14 of a screw 8. Integrally formed with the shank 14 is a flange 15 which is provided with a slot 16 to provide means for turning the screw with an ordinary screwdriver. A sleeve 17 of an elastomeric material such as natural and synthetic rubbers is disposed about the shank, suitable examples of the latter by way of example, and not limitation, being neoprene, styrene-butadiene rubber and nitrile rubbers and butyl rubber.

In the assembly of the system the splines 6 of the center post 7 are inserted into the keyways of the vertical frame, then the insert 10 follows the center post. The screw 8 is rotated into the tapped bore 18 of the spline 12 causing the sleeve 17 to shorten and expand radially to grip the side wall 19 of the keyways 5.

To disassemble it is only necessary to counter rotate the screw 8 to disengage the sleeve from the side wall 10 in order to release the insert, remove the insert and the center post 7, rearrange the panels as desired, reinsert the post 7, reinsert the insert 10 and turn the screws 8 to secure the frames against relative longitudinal movement.

Having the benefit of the foregoing disclosure it will be appreciated by those skilled in the art that equivalent alternatives to the preferred embodiments can be visualized, all such being intended to be embraced by the claims appended hereto.

What is claimed is:

1. A modular display panel system comprising a plurality of panels, each of said panels having a vertical frame on at least one side; at least one vertical post; means defining closely fitting longitudinal mating splines and keyways carried by said post and vertical frames; and means for temporarily and releasably preventing longitudinal movement of said frames relative one another comprising an insert adapted to fit said keyways, an elastomeric material carried by said insert and means for expanding and contracting said elastomer to frictionally engage the walls of said keyways.

2. The modular display panel system of claim 1 wherein said means for expanding and contracting said elastomeric material comprises an insert adapted to slidingly fit within said keyways; means defining a tapped bore in an end of said inserts; a screw disposed in said tapped bore and having a threaded shank and a head forming a flange on said shank; an elastomeric sleeve carried by said shank between said insert and head; and means for turning said screw, whereby said sleeve shortens and expands radially to frictionally engage the walls of said keyways when the said screw is turned.

3. The modular display panel system of claim 1 wherein said splines are carried by said post and said keyways are carried by said vertical frames.

4. A modular display panel connecting system comprising a plurality of vertical frame members; at least one vertical post; means defining closely fitting longitudinal mating splines and keyways carried by said post and vertical frame members; and means for temporarily and releasably preventing longitudinal movement of said frame members relative one another comprising an insert adapted to fit the keyways, an elastomeric material carried by said insert, and means for expanding and contracting said elastomer to frictionally engage the walls of said keyways.

5. The modular display panel connecting system of claim 4 wherein said means for expanding and contracting said elastomeric material comprises an insert adapted to slidingly fit within said keyways; means defining a tapped bore in an end of said inserts; a screw disposed in said tapped bore and having a threaded shank and a head forming a flange on said shank; an elastomeric sleeve carried by said shank between said insert and head; and means for turning said screw, whereby said sleeve shortens and expands radially to frictionally engage the walls of said keyways when said screw is turned.

6. The modular display panel connecting system of claim 4 wherein said splines are carried by said post and said keyways are carried by said vertical frames.

* * * * *